US007913433B2

(12) United States Patent
Jiang et al.

(10) Patent No.: US 7,913,433 B2
(45) Date of Patent: Mar. 29, 2011

(54) MEASURES FOR KEEPING A DEGREE OF CONTAMINATION OF A STEAM GENERATOR INCLUDING ITS CONTENTS BELOW A PREDETERMINED MAXIMUM

(75) Inventors: Yong Jiang, Singapore (SG); Tang Pong Har, Singapore (SG); Lanying Ji, Singapore (SG); Mun Thoh Ma, Singapore (SG); Leo Hubert Maria Krings, Roosendaal (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 901 days.

(21) Appl. No.: 11/722,479

(22) PCT Filed: Dec. 21, 2005

(86) PCT No.: PCT/IB2005/054357

§ 371 (c)(1),
(2), (4) Date: Jun. 21, 2007

(87) PCT Pub. No.: WO2006/070317

PCT Pub. Date: Jul. 6, 2006

(65) Prior Publication Data

US 2010/0018085 A1 Jan. 28, 2010

(30) Foreign Application Priority Data

Dec. 28, 2004 (EP) ..... 04107013

(51) Int. Cl.
*D06F 75/18* (2006.01)
*D06F 75/26* (2006.01)

(52) U.S. Cl. ..... 38/77.9; 38/77.83

(58) Field of Classification Search ..... 38/74–77.9; 219/245; 210/696
See application file for complete search history.

(56) References Cited

U.S. PATENT DOCUMENTS

| | | | | |
|---|---|---|---|---|
| 4,281,636 | A * | 8/1981 | Vegh et al. | 126/369 |
| 5,602,958 | A * | 2/1997 | Vergnes | 392/395 |
| 5,832,639 | A * | 11/1998 | Muncan | 38/77.6 |
| 5,858,245 | A * | 1/1999 | Gallup | 210/698 |
| 6,163,990 | A * | 12/2000 | Urata et al. | 38/77.8 |
| 6,587,753 | B2 * | 7/2003 | Fowee | 700/266 |
| 6,613,244 | B2 * | 9/2003 | Fry | 252/8.91 |
| 6,641,754 | B2 * | 11/2003 | Buentello et al. | 252/180 |
| 6,655,322 | B1 * | 12/2003 | Godwin et al. | 122/379 |
| 7,340,853 | B2 * | 3/2008 | Ching et al. | 38/77.5 |

FOREIGN PATENT DOCUMENTS

EP 1045932 10/2000

* cited by examiner

*Primary Examiner* — Ismael Izaguirre

(57) ABSTRACT

A steam ironing device includes a steam iron, a steam generator for generating steam and supplying steam to the steam iron, and a supply device for supplying water to the steam generator. During operation of the steam ironing device, scale is formed in the steam generator, and the water in the steam generator gradually gets contaminated with ions. In order to clean the steam generator and replace the water with fresh water, the steam generator is regularly subjected to an auto-rinsing process. A moment at which this process needs to take place is a moment at which an amount of scale and/or a concentration of ions have exceeded a predetermined maximum. The amount of scale and/or the concentration of ions are indirectly monitored by keeping account of a total quantity of water that has been supplied to the steam generator since a set starting point.

15 Claims, 3 Drawing Sheets

Figure 1:
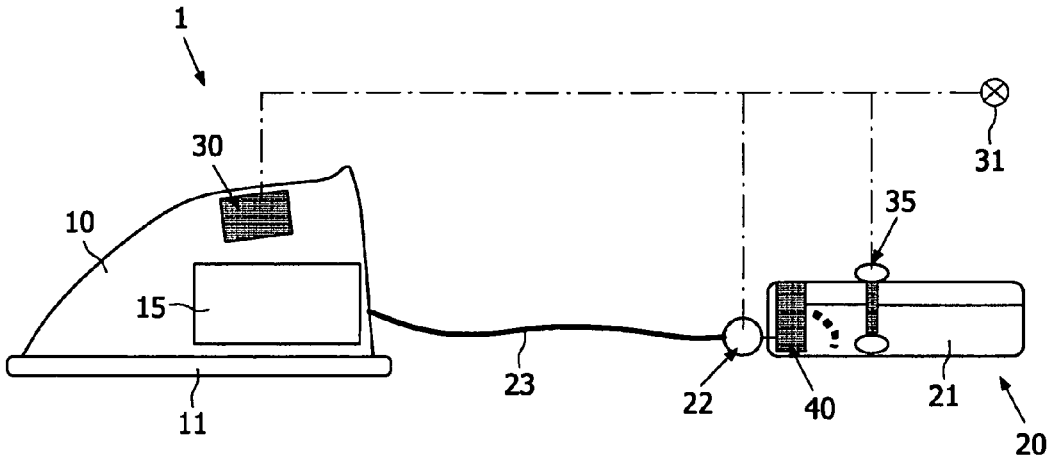

MEASURES FOR KEEPING A DEGREE OF CONTAMINATION OF A STEAM GENERATOR INCLUDING ITS CONTENTS BELOW A PREDETERMINED MAXIMUM

The present invention relates in general to a method for determining a moment during operation of a device having a steam generator at which a degree of contamination of a steam generator including its contents exceeds a predetermined maximum.

A well-known example of a device having a steam generator is a steam ironing device which comprises a steam iron having a soleplate for contacting objects to be ironed. The steam generator may be arranged inside the steam iron, but may also be arranged in a separate stand. In the latter case, the steam generator is larger and the steam production of the steam generator is higher.

For sake of clarity, it is noted that the term "steam generator" should be understood such as to cover all possible devices or elements of devices which are capable of heating water to steam. Well-known examples of a steam generator are a steam chamber arranged inside a steam iron and a boiler.

During operation of the steam ironing device, the water in the steam generator is heated, as a consequence of which scale is formed in the steam generator. This scale formation causes problems, as it may occur that scale particles are displaced from the steam generator to the steam iron, and land on an object to be ironed, causing stains on this object. Furthermore, over time, the water in the steam generator gradually gets contaminated with ions. This phenomenon is caused by the fact that during operation of the arrangement, only water is evaporated, while most of the other components which are present in the water stay behind. In a steam generator containing contaminated water, a foaming effect occurs during heating of the water, which disturbs a continuous supply of steam by the steam generator, and which may cause the steam generator to supply hot water along with the steam.

It is noted that during normal operation of the steam ironing device, measures are taken to assure that the steam generator always contains a predetermined minimum amount of water, so that it is possible to have a continuous steam production. Therefore, during operation, the steam generator is never completely emptied, and the water gets more and more contaminated with ions.

The extent to which the formation of scale takes place is related to a characteristic of the water referred to as hardness of the water. Water hardness is a quantity which is determined by a concentration of polyvalent cations in the water, in particular a concentration of calcium ions and magnesium ions. Waters having high hardness values are referred to as hard waters, whereas waters having low hardness values are referred to as soft water.

The extent to which the contamination of the water with ions takes place is related to a characteristic of the water referred to as total dissolved salt concentration, or, in short TDS concentration. TDS concentration is a quantity which is determined on the basis of a measurement by weight of dissolved materials in a given volume of water.

In order to reduce the influence of the scale formation and the increase of the TDS concentration on the performance of the steam ironing device, measures are taken to reduce the water hardness and/or the steam generator is rinsed from time to time. Basically, a reduction of the water hardness involves a replacement of calcium ions and magnesium ions while using ion exchange resin, whereas rinsing of the steam generator leads to a removal of scale particles. The TDS concentration is reduced by filling the steam generator with fresh water after a rinsing process has taken place.

In EP 1 045 932, a steam iron with an indicator for indicating calcification is disclosed. The steam iron is provided with a timer for measuring an accumulated time of use of the iron since a set starting point, and a control unit for activating the indicator when the accumulated time exceeds a predetermined threshold level.

The timer measures the times of use of the steam iron. The accumulated time of use is taken as a measure of the amount of scale deposited in a steam chamber and steam vents of the steam iron. When the accumulated time of use exceeds a threshold, the calcification indicator is activated to warn a user of the steam iron that a self-clean action, during which the steam chamber is rinsed with cold water, is to be performed. According to one possibility, the accumulated time of use is corrected with a weighting factor which is dependent of the hardness of the water to be steamed. According to another possibility, the threshold level for activating the indicator is made dependent on the hardness of the water. The softer the water, the longer an interval between two self-clean actions can be.

It is an objective of the present invention to provide a method which is suitable to be used for determining a moment at which the contamination of the steam generator and its contents, for example an amount of formed scale and/or a TDS concentration, has exceeded a predetermined maximum, and which is more accurate than the known method in which the accumulated time of use is measured, whether a correction factor is applied or not. The objective is achieved by means of a method, comprising the steps of keeping account of a value of an accumulated amount of water that has been supplied to the steam generator since a set starting point; and comparing the found value to a predetermined threshold value in order to check whether the found value is above the threshold value.

When the method according to the present invention is applied in a steam ironing device, the moment at which a rinsing process of the steam generator needs to be performed may easily be determined on the basis of a determination of a total amount of water that has been supplied to the steam generator since a set starting point, which is the start of a first use after a preceding rinsing process has been performed, for example. Furthermore, in case the steam ironing device comprises an ion exchange cartridge, it is possible to determine the moment at which the ion exchange resin is exhausted by applying the method according to the invention.

The present invention is based on the insight that the contamination of the water in the steam generator and the amount of scale is closely related to the total amount of water that has been supplied to the steam generator since a preceding cleaning action and/or a preceding exchange of an ion exchange cartridge. Therefore, it is possible to take the total amount of water that has been supplied to the steam generator as an accurate measure for the condition of the water and the amount of scale deposit. The threshold for the total amount of supplied water is associated with a maximum allowable contamination of the water and a maximum allowable amount of scale deposit in the steam generator. When it appears that the value of the accumulated amount of water is above the threshold value, it is concluded that a degree of contamination of the steam generator and its contents has exceeded an allowable maximum.

In many practical situations, the water is supplied to the steam generator by means of a water pump. In such situations, it is preferred if the value of the accumulated amount of water is determined on the basis of characteristics of the operation of the pump. In particular, it is preferred if the value of the accumulated amount of water is determined on the basis of set values of a flow rate and a pulse rate of the pump. It is relatively easy to realize this preferred way of carrying out the method according to the present invention in practice, as it is possible to make use of a controller for controlling the pump.

It is also possible that an electro-valve or the like is applied for controlling a supply of water to the steam generator. In such a case, it is advantageous if the value of the accumulated amount of water is determined on the basis of characteristics of the operation of the electro-valve.

Application of the method according to the present invention yields even more accurate results if the threshold level is determined in dependence of the water hardness. Therefore, preferably, the method further comprises the steps of determining a hardness of the water at the starting point; and setting the threshold value for the accumulated amount of water in dependence of the found water hardness, on the basis of a predetermined relation between the water hardness and the threshold value. Any known method for determining the water hardness may be applied. The predetermined relation between the water hardness and the threshold value may for example be laid down in the form of a look-up table that is stored in a micro-controller or the like. In a similar manner, the threshold level may be determined in dependence of the TDS concentration, or in dependence of both the water hardness and the TDS concentration.

Once it has been determined that the contamination of the steam generator and its contents is above an allowable maximum, various actions may be taken. In the first place, it is possible that a device of which the steam generator is part comprises an indicator, and that the indicator is activated in order to warn a user of the device that it is time to perform a rinsing process an/or exchange an ion exchange cartridge. The indicator may be realized in any suitable way, and preferably comprises a light. In the second place, it is possible that the device of which the steam generator is part comprises supplying means for supplying anti-foaming agent to the water that is intended to be used for steaming, and that these means are activated.

Furthermore, the present invention relates to a steam ironing device, comprising a steam generator and contamination sensing means for determining a moment during operation of the device at which a degree of contamination of the steam generator and its contents exceeds a predetermined maximum.

The present invention also relates to a steam ironing device, comprising a steam generator; a steam iron; and supplying means for supplying anti-foaming agent to the water that is intended to be used for steaming. By means of a supply of anti-foaming agent, it is achieved that a cleaning process of the steam generator and its contents, for example a rinsing process, may be performed less regularly.

In a practical embodiment, the steam supplying device comprises a water tank and a water pump for displacing water from the water tank to the steam generator. Preferably, in such an embodiment, the supplying means are adapted to introducing anti-foaming agent at an inlet of the pump, or, in other words, at a suction side of the pump, i.e. a side of the pump which is connected to the water tank. In this way, there is no need for a separate pump for generating a flow of anti-foaming agent towards the steam generator.

Figure 2:
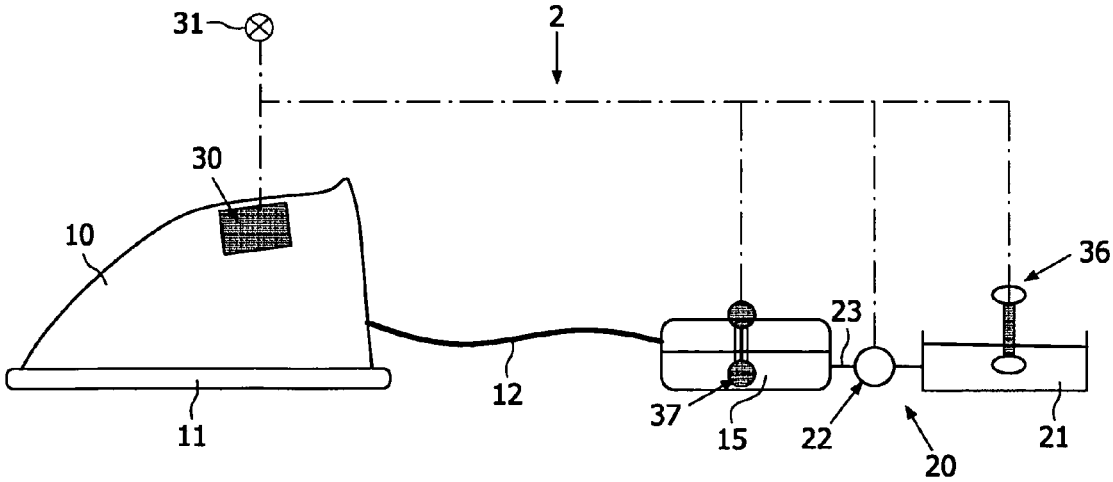
Figure 3:
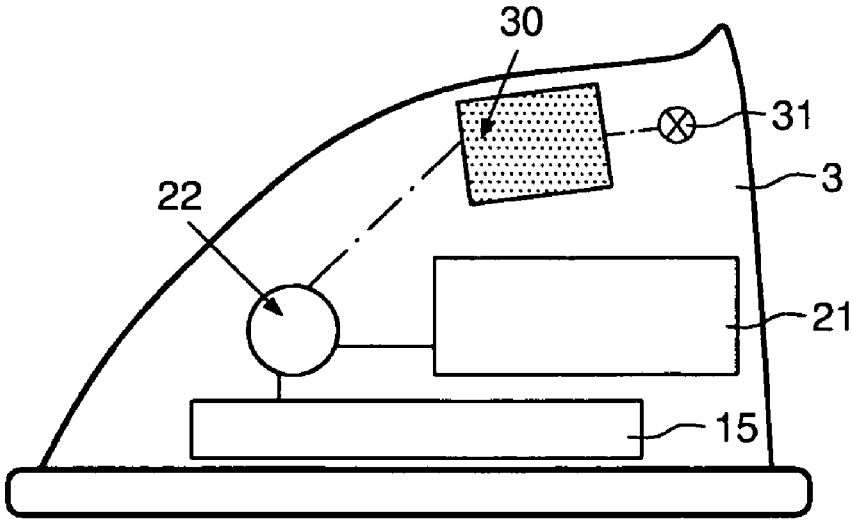
Figure 4:
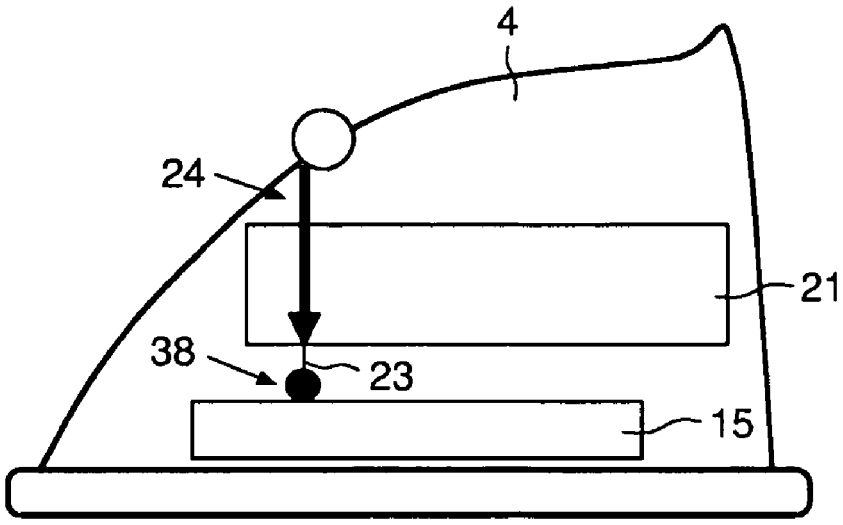
Figure 5:
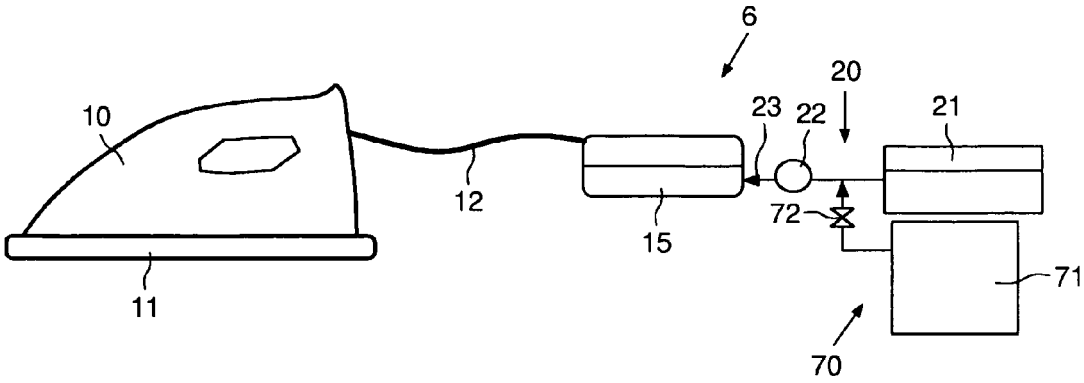
Figure 6:
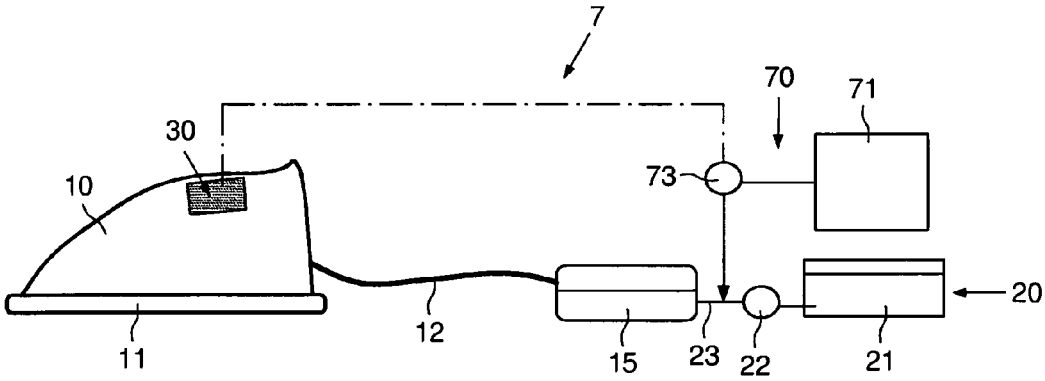

The present invention will now be explained in greater detail with reference to the Figures, in which similar parts are indicated by the same reference signs, and in which:

FIG. 1 diagrammatically shows a steam ironing device according to a first preferred embodiment of the present invention;

FIG. 2 diagrammatically shows a steam ironing device according to a second preferred embodiment of the present invention;

FIG. 3 diagrammatically shows an iron according to a first preferred embodiment of the present invention;

FIG. 4 diagrammatically shows an iron according to a second preferred embodiment of the present invention;

FIG. 5 diagrammatically shows a first steam ironing device comprising a steam generator and supplying means for supplying anti-foaming agent to the water that is intended to be used for steaming; and FIG. 6 diagrammatically shows a second steam ironing device comprising a steam generator and supplying means for supplying anti-foaming agent to the water.

FIG. 1 diagrammatically shows a steam ironing device 1 according to a first preferred embodiment of the present invention, which will hereinafter also be referred to as first steam ironing device 1. The steam ironing device 1 comprises a steam iron 10 having a soleplate 11 for contacting objects to be ironed. The steam iron 10 serves for supplying heat and steam to the objects to be ironed, wherein the soleplate 11 serves for supplying the heat, and wherein a steam generator 15 serves for generating and supplying the steam. In the shown example, the steam generator 15 is located in the steam iron 10.

During operation of the steam ironing device 1, water is supplied to the steam generator 15. In the steam generator 15, water is converted to steam under the influence of heat. For the purpose of supplying water to the steam generator 15, the steam ironing device 1 comprises water supplying means 20 having a water tank 21 for containing water, a water pump 22 for forcing water to flow from the water tank 21 to the steam generator 15, and a water hose 23 for conducting the water from the pump 22 to the steam generator 15.

The steam ironing device 1 comprises a microprocessor 30, which, among other things, is adapted to controlling the pump 22. For example, the microprocessor 30 is connected to sensing means (not shown) for sensing a water level in the steam generator 15. In case it appears that the water level is at a predetermined minimum, the microprocessor 30 activates the pump 22 to displace water from the water tank 21 to the steam generator 15. In FIG. 1, an interaction between the microprocessor 30 and the pump 22, which may be realized through electrical signals, is diagrammatically depicted by means of a dot and dash line.

Inside the water tank 21, an ion exchange cartridge 40 is arranged for reducing the hardness of the water contained by the water tank 21. The ion exchange cartridge 40 comprises ion exchange resin, which is capable of reducing a concentration of calcium ions and magnesium ions in the water. From the moment the ion exchange cartridge 40 is placed in the water tank 21, the ion exchange resin performs its function of softening the water until a moment at which the ion exchange resin is exhausted. According to an important aspect of the present invention, the microprocessor 30 is capable of determining the moment at which the ion exchange resin is exhausted on the basis of characteristics of the operation of the pump 22 and a determined hardness of the water.

When a new ion exchange cartridge 40 is placed in the water tank 21, the microprocessor 30 activates a hardness detection sensor 35 to measure the hardness of the water. In FIG. 1, an interaction between the microprocessor 30 and the hardness detection sensor 35, which may be realized through electrical signals, is diagrammatically depicted by means of a dot and dash line.

The lifetime of the ion exchange cartridge 40 and the associated total amount of water that can be treated by the cartridge 40 are dependent of the water hardness. For example, a specific ion exchange cartridge 40 is able to treat 30 liters of hard water having a hardness of 15° dH, while the same cartridge 40 is able to treat only 25 liters of hard water having a hardness of 18° dH. In the microprocessor 30, a look-up table is stored, containing combinations of water hardness and an amount of water that is allowed to be supplied to the steam generator 15 before the ion exchange cartridge 40 needs to be replaced, in other words, that is associated with an end of the lifetime of the ion exchange cartridge 40. A value of this amount of water is also referred to as threshold value. On the basis of the outcome of the measurement of the water hardness, the microprocessor 30 determines a suitable threshold value.

Within the scope of the present invention, it is not necessary that a hardness detection sensor 35 is applied for the purpose of generating data regarding the water hardness. It is also possible to make use of a manually adjustable dial or the like. In such a case, a user of the steam ironing device 1 needs to be aware of the hardness of the water that is used, and needs to set the dial in accordance with this known water hardness.

In order to determine the amount of water that is supplied to the steam generator 15, use is made of an electronic pulse controller which is applied for controlling the flow rate of the pump 22. The pulse controller is capable of transmitting information regarding the flow rate and a set pulse rate to the microprocessor 30, which continuously calculates the accumulated amount of water passing through the pump 22 and compares the value of the calculated amount of water to the threshold value. As soon as it appears that the value of the calculated amount of water is above the threshold value, it is concluded that the ion exchange cartridge 40 needs to be replaced, and the microprocessor 30 transmits an associated signal. For example, the steam ironing device 1 is equipped with an indicator light 31, which is activated by the microprocessor 30 as soon as the value of the calculated amount of water appears to be above the threshold value. In FIG. 1, an interaction between the microprocessor 30 and the indicator light 31, which may be realized through electrical signals, is diagrammatically depicted by means of a dot and dash line. By means of an activation of the indicator light 31, the user of the steam ironing device 1 is warned that replacement of the ion exchange cartridge 40 is required. When the ion exchange cartridge 40 is replaced, the memory of the microprocessor 30 gets cleared from data concerning the previous cartridge 40, and the above-described method comprising the steps of measuring the water hardness and determining the amount of water that is supplied to the steam generator 15 is repeated.

The same method which is used for determining a moment at which the ion exchange cartridge 40 needs to be replaced is also suitable to be used for determining a moment at which the steam generator 15 needs to be rinsed in order to remove scale particles. For the purpose of determining a suitable threshold value for the total amount of water that is to be supplied to the steam generator 15, the microprocessor 30 contains a look-up table containing combinations of water hardness or TDS concentration, and an amount of water that is allowed to be supplied to the steam generator 15 before the steam generator 15 needs to be rinsed, in other words, that is associated with a maximum allowable amount of scale deposit in the steam generator 15. When the threshold value is determined in dependence of the TDS concentration, it is important that the steam ironing device 1 comprises a suitable sensor.

In a preferred way of carrying out the method according to the present invention, the water hardness can be measured in terms of a concentration of specific ions, namely the concentration of calcium ions ($Ca^{2+}$ ions). The concentration of calcium ions is very useful as an indication of the water hardness in fresh water samples. Even though the water hardness is also determined by the presence of other ions such as magnesium ions ($Mg^{2+}$ ions) in the water, the concentration of calcium ions alone is still a reliable indicator of the water hardness, as the calcium ions normally constitute the predominate hardness ions. By using membrane-based ion-selective electrodes, it is possible to measure the concentration of calcium ions on the basis of an electrical voltage output.

In a practical way of measuring the TDS concentration in the water, the electrical conductivity of the water is measured. For most water solutions, it is true that a higher concentration of dissolved salt leads to more ions in the water, and therefore leads to a higher electrical conductivity of the water. The electrical conductivity can be measured in any suitable way, for example by means of a two-electrode cell, wherein a voltage is applied to two flat plates immersed in the solution, and wherein the resulting current is measured. In the process, Ohm's law is applied, on the basis of which it is known that the conductance is the quotient of the current and the voltage.

FIG. 2 diagrammatically shows a steam ironing device 2 according to a second preferred embodiment of the present invention, which will hereinafter also be referred to as second steam ironing device 2.

Like the first steam ironing device 1, the second steam ironing device 2 comprises a steam iron 10 having a soleplate 11, a steam generator 15, water supplying means 20 having a water tank 21, a water pump 22 and a water hose 23, a microprocessor 30 for controlling the device 1 and an indicator light 31. In FIG. 2, an interaction between the microprocessor 30 and the pump 22, which may be realized through electrical signals, is diagrammatically depicted by a dot and dash line. The same applies to an interaction between the microprocessor 30 and the indicator light 31.

In the second steam ironing device 2, the steam generator 15 is arranged outside of the steam iron 10, wherein a connection between the steam generator 15 and the steam iron 10 is established through a steam hose 12. Furthermore, in the second steam ironing device 2, the pump 22 is an electromechanical pump.

The steam generator 15 needs to be rinsed from time to time in order to remove scale particles that have been formed during operation of the steam generator 15. The right moment for rinsing is determined on the basis of a measurement of the TDS concentration of the feed water and an associated threshold value for the value of the maximum amount of water that is allowed to be supplied to the steam generator 15 before the steam generator 15 needs to be rinsed, in other words, that is associated with a maximum allowable amount of scale deposit in the steam generator 15. For the purpose of measuring the TDS concentration of the feed water, a TDS detection sensor 36 is arranged in the water tank 21. In FIG. 2, an interaction between the TDS detection sensor 36 and the microprocessor 30, which may be realized through electrical signals, is diagrammatically depicted by means of a dot and dash line.

In the microprocessor 30, a look-up table is stored, containing combinations of TDS concentration and an amount of water that is allowed to be supplied to the steam generator 15 before the rinsing process needs to be performed, wherein a value of this amount of water constitutes a threshold value. On the basis of the outcome of the measurement of the TDS concentration, the microprocessor 30 determines a suitable threshold value. The table is drafted on the basis of the fact that when the TDS concentration of the feed water is detected, it is possible to predict the TDS concentration of the residual water in the steam generator 15 when a certain amount of water has been supplied to the steam generator 15 and has been evaporated to steam. For example, in a steam generator 15 which is initially provided with fresh feed water having a TDS concentration of 30 ppm (parts per million), the residual water is expected to have a higher TDS concentration, for example 3,000 ppm after 25 liters of water have passed through the steam generator 15 for steam generation. In case the fresh water has a higher TDS concentration, for example a TDS concentration of 75 ppm, the higher TDS concentration of 3,000 ppm is already reached when 10 liters of water have passed through the steam generator 15.

In the second steam ironing device 2, the amount of water that is supplied to the steam generator 15 is determined by counting a pulsing rate and an activation time of the pump 22. The microprocessor 30 continuously calculates the accumulated amount of water passing through the pump 22 and compares the value of the calculated amount of water to the threshold value. As soon as it appears that the value of the calculated amount of water is above the threshold value, the microprocessor 30 activates the indicator light 31, so that a user of the steam ironing device 2 may know that the moment for performing a rinsing process has come.

After the rinsing process has been performed, the memory of the microprocessor 30 is cleared from data concerning the previous time interval, and the above-described method comprising the steps of measuring the TDS concentration and the amount of water that is supplied to the steam generator 15 is repeated.

In an alternative embodiment of the second steam ironing device 2, the TDS concentration of the water that is present inside the steam generator 15 is directly measured by means of a water level sensor 37 which is arranged in the steam generator 15, and which is adapted to measuring the water level by measuring the electrical conductivity of the water. In such an embodiment, the microprocessor 30 is adapted to comparing the measured TDS concentration to a maximum allowable TDS concentration, and to activating the indicator light 31 as soon as it appears that the first concentration is higher than the latter concentration. In FIG. 2, an interaction between the microprocessor 30 and the water level sensor 37, which may be realized through electrical signals, is diagrammatically depicted by means of a dot and dash line.

FIG. 3 diagrammatically shows a steam iron 3 according to a first preferred embodiment of the present invention, which will hereinafter also be referred to as first steam iron 3.

Inside the steam iron 3, a steam generator 15 for generating steam and supplying steam to objects to be ironed, a water tank 21 for containing fresh feed water, and an electromechanical water pump 22 for forcing the water to flow from the water tank 21 to the steam generator 15 are arranged. Furthermore, a microprocessor 30 which, among other things, serves for controlling the pump 22 is arranged inside the steam iron 3. In FIG. 3, an interaction between the microprocessor 30 and the pump 22, which may be realized through electrical signals, is diagrammatically depicted by means of a dot and dash line.

In the first steam iron 3, an electronic pulse controller is applied for controlling the flow rate of the pump 22. The pulse controller is also able to count the total amount of water that is delivered into the steam generator 15 by knowing the pulse rate. The microprocessor 30 serves for storing and calculating the total amount of water passing through the pump 22 and for comparing the found value to a value threshold associated with a maximum duration of a time interval between two processes of rinsing the steam generator 15. As soon as it appears that the value of the total amount of water is above the threshold value, the microprocessor 30 activates an indicator, for example an indicator light 31. In FIG. 3, an interaction between the microprocessor 30 and an indicator light 31, which may be realized through electrical signals, is diagrammatically depicted by means of a dot and dash line.

After the rinsing process has been performed, the memory of the microprocessor 30 is cleared from data concerning the previous time interval, and the above-described method for determining a moment at which the rinsing process needs to be performed is repeated.

FIG. 4 diagrammatically shows a steam iron 4 according to a second preferred embodiment of the present invention, which will hereinafter also be referred to as first steam iron 4.

Inside the steam iron 4, a steam generator 15, a water tank 21 and a water hose 23 for connecting the water tank 21 to the steam generator 15 are arranged. The steam iron 4 comprises a mechanical dosing device 24 for feeding water in a controlled manner from the water tank 21 to the steam generator 15. In FIG. 4, a flow of water is diagrammatically depicted by means of an arrow. Furthermore, the steam iron 4 comprises a flow meter 38, which is arranged between the dosing device 24 and the steam generator 15.

In the second steam iron 4, the total amount of water that is supplied to the steam generator 15 is measured by means of the flow meter 38. When the value of the total amount of water exceeds a predetermined threshold value, an alert is activated in order to warn a user of the second steam iron 4 that it is time for a rinsing process of the steam generator 15. Preferably, the rinsing process is performed with a relatively large amount of water, approximately 150 grams per minute.

Measures such as regularly performed rinsing processes or the application of an ion exchange cartridge 40 are useful in preventing undesired situations in which an amount of scale particles in the steam generator 15 and/or a TDS concentration of water that is present inside the steam generator 15 increase to such a level that during operation of the steam generator 15, effects such as foaming of the water and the steam generator 15 letting out hot water together with the steam take place.

The frequency at which the rinsing processes need to take place may be reduced by applying supplying means 70 for supplying anti-foaming agent to the water that is intended to be used for steaming. A first steam ironing device 6 comprising such means 70 is diagrammatically shown in FIG. 5, and a second steam ironing device 7 comprising such means is diagrammatically shown in FIG. 6. Besides a steam generator 15 and the supplying means 70, the shown steam ironing devices 6, 7 also comprise a steam iron 10 having a soleplate 11 for contacting objects to be ironed, a water supplying means 20 having a water tank 21, a water pump 22 and a water hose 23, and a steam hose 12. The steam generator 15 is arranged outside of the steam iron 10.

Anti-foaming agent (which may also be referred to as de-foaming agent) works either as a foam inhibitor or as a foam breaker, or as both. The agent reduces a gradient in surface tension in a liquid film between bubbles, so that the surface tension in the liquid film between the bubbles gets constant again. As a result, the liquid film between the bubbles drains more easily and breaks when it is thick. The surface tension of the water is also reduced by the incorporation of anti-foaming agent in the liquid film, the extent of the reduction depending on the concentration of the anti-foaming agent.

Several ways of providing the water that is intended to be used for steaming with the anti-foaming agent exist. In the first steam ironing device 6 comprising supplying means 70, the anti-foaming agent is introduced at a suction side of the pump 22, i.e. a side of the pump 22 which is connected to the water tank 21. During operation of the device 6, the pump 22 simultaneously takes in both feeding water and anti-foaming agent. A container 71 for containing the anti-foaming agent is connected to the suction side of the pump 22 through a valve 72, which can be used to control the release of anti-foaming agent. Alternatively, the supplying means 70 may comprise another pump (not shown) for dosing anti-foaming agent to the suction side of the pump 22. As a result of the introduction of anti-foaming agent into the water that is intended to be used for steaming, phenomena such as foaming of the water or the steam generator 15 letting out hot water together with the steam are avoided.

In the second steam ironing device 7 comprising supplying means 70, the anti-foaming agent is directly introduced into the steam generator 15. In this device 7, the supplying means 70 comprise a pump 73 for pumping the anti-foaming agent to the steam generator 15. This pump 73 is controlled by means of a microprocessor 30, wherein the microprocessor 30 is programmed such as to activate the pump 73 in case it appears that the TDS concentration of the water that is present inside the steam generator 15 is higher than a maximum allowable TDS concentration. In FIG. 6, an interaction between the microprocessor 30 and the pump 73, which may be realized through electrical signals, is diagrammatically depicted by means of a dot and dash line. Various possibilities for determining whether the TDS concentration has become higher than a maximum allowable TDS concentration exist, including the above-described possibility of determining a total amount of water supplied to the generator and comparing a determined value of this amount to a threshold value, wherein the threshold value may be determined in dependence of an initial TDS concentration of the water. It is noted that the valve 72 of the first steam ironing device 6 comprising supplying means 70 may be controlled in a similar manner.

Alternatively, the anti-foaming agent may be directly released into the water tank 21, via a diffusion mechanism or by means of a pump, for example. The process of releasing anti-foaming agent into the water tank 21 may be activated by a user, by simply pushing a release button each time the water tank 21 is filled with fresh water. However, this process may also be performed automatically, wherein there is no need for interference of the user.

It has already been noted that the extent to which phenomena such as foaming of the water that is present inside the steam generator 15 and a release of hot water together with the steam occur is strongly related to the TDS concentration in the water. Therefore, it is also possible to control the supply of anti-foaming agent on the basis of an actual measurement of the TDS concentration of the water that is present inside the steam generator 15. Research has shown that in case of a steam generator 15 operating at a pressure that is below 20 bar, the TDS concentration should be kept below 3,000 ppm in order to avoid the mentioned phenomena.

Preferably, during operation of the steam ironing devices 6, 7 comprising supplying means 70, a regular or continuous check of the amount of anti-foaming agent that is present in the container 71 is performed, and a user of the device 7 is warned of a imminent lack of anti-foaming agent in case the container 71 contains less anti-foaming agent than an allowable minimum amount. Suitable means such as a sensor and an alert are provided for performing the functions of checking the amount of anti-foaming agent and warning the user.

It will be clear to a person skilled in the art that the scope of the present invention is not limited to the examples discussed in the foregoing, but that several amendments and modifications thereof are possible without deviating from the scope of the present invention as defined in the attached claims.

In the foregoing, several steam ironing devices 1, 2, 3, 4, 6, 7 are disclosed. A second steam ironing device 2, shown in FIG. 2, comprises a steam iron 10, a steam generator 15 for generating steam and supplying steam to the steam iron 10, and means 20 for supplying water to the steam generator 15. During operation of the device 2, scale is formed in the steam generator 15, and the water in the steam generator 15 gradually gets contaminated with ions. In order to clean the steam generator 15 and replace the water by fresh water, the steam generator 15 is regularly subjected to an auto-rinsing process. A moment at which this process needs to take place is a moment at which an amount of scale and/or a concentration of ions have exceeded a predetermined maximum. The amount of scale and/or the concentration of ions are indirectly monitored by keeping account of a total quantity of water that has been supplied to the steam generator 15 since a set starting point.

The invention claimed is:

1. A method for determining a moment during operation of a steam ironing device having a steam generator at which a degree of contamination contents of the steam generator exceeds a predetermined maximum, comprising the acts of:

keeping account of a value of an accumulated amount of water that has been supplied to the steam generator since a set starting point; and comparing the value to a predetermined threshold value in order to check whether the value is above the threshold value; and determining the moment at which the degree of contamination contents of the steam generator exceeds the predetermined maximum as being when the value is above the predetermined threshold value.

2. The method according to claim 1, wherein a water pump is applied for delivering water to the steam generator, and wherein the value of the accumulated amount of water is determined on the basis of characteristics of the operation of the pump.

3. The method according to claim 2, wherein the value of the accumulated amount of water is determined on the basis of set values of a flow rate and a pulse rate of the pump.

4. The method according to claim 1, wherein an electro-valve is used for controlling a supply of water to the steam generator, and wherein the value of the accumulated amount of water is determined on the basis of characteristics of the operation of the electro-valve.

5. The method according to claim 1, further comprising the acts of:

determining a hardness of the water at the starting point; and setting the threshold value for the accumulated amount of water in dependence of the found water hardness, on the basis of a predetermined relation between the water hardness and the threshold value.

6. The method according to claim 1, further comprising the acts of:

determining a concentration of total dissolved salt in the water at the starting point; and setting the threshold value for the accumulated amount of water in dependence of the found concentration, on the basis of a predetermined relation between the total dissolved salt concentration and the threshold value.

7. A steam ironing device, comprising:

a steam generator; and a contamination sensor configured to determine a moment during operation of the steam ironing device at which a degree of contamination of contents of the steam generator exceeds a predetermined maximum, wherein the contamination sensor comprises a water flow accounting device for keeping account of a value of an accumulated amount of water that has been supplied to the steam generator since a set starting point, and a controller configured to compare the value of the accumulated amount of water to a predetermined threshold value and determine the moment based on when the value exceeds the predetermined threshold value.

8. The steam ironing device according to claim 7, further comprising a water pump for delivering water to the steam generator and a pump controller for controlling the operation of the pump, wherein the pump controller is adapted to determining the value of the accumulated amount of water on the basis of set values of a flow rate and a pulse rate of the pump.

9. The steam ironing device according to claim 7, further comprising a sensor configured to sense a hardness of the water, wherein the controller has access to information regarding a predetermined relation between the water hardness and the threshold value for the accumulated amount of water, and wherein the controller is configured to determine the threshold value on the basis of this information and the found water hardness.

10. The steam ironing device according to claim 7, further comprising a sensor configured to sense a concentration of total dissolved sail in the water, wherein the controller has access to information regarding a predetermined relation between the total dissolved salt concentration and the threshold value for the accumulated amount of water, and wherein the controller is configured to determine the threshold value on the basis of this information and the found concentration.

11. The steam ironing device according to claim 7, further comprising an indicator, wherein the controller is configured to activate the indicator in case it is found that the value of the accumulated amount of water is above the threshold value.

12. The steam ironing device according to claim 7, further comprising a supply device configured to supply anti-foaming agent to the water that is intended to be used for steaming, wherein the controller is configured to activate the supply device in case it is found that the value of the accumulated amount of water is above the threshold value.

13. A steam ironing device comprising:

a steam generator;

a contamination sensor configured to determine a moment during operation of the steam ironing device at which a degree of contamination of contents of the steam generator exceeds a predetermined maximum; wherein the contamination sensor comprises a water flow accounting device for keeping account of a value of an accumulated amount of water that has been supplied to the steam generator since a set starting point, and a controller configured to compare the value of the accumulated amount of water to a predetermined threshold value and determine the moment based on when the value exceeds the predetermined threshold value; and a supply device configured to supply anti-foaming agent to water supplied to the steam generator, wherein the controller is further configured to activate the supply device when the value of the accumulated amount of water exceeds the predetermined threshold value.

14. The steam ironing device according to claim 13, further comprising a water tank and a water pump for displacing water from the water tank to the steam generator, wherein the supply device is configured to introduce the anti-foaming agent at an inlet of the water pump.

15. The steam ironing device according to claim 13, comprising an iron and an active ironing board for supporting objects to be ironed and supplying steam to these objects.

* * * * *